US012516467B1

(12) United States Patent
Crane

(10) Patent No.: US 12,516,467 B1
(45) Date of Patent: Jan. 6, 2026

(54) GARMENT AND EQUIPMENT DRYING BAG

(71) Applicant: Brandon Crane, Rome, NY (US)

(72) Inventor: Brandon Crane, Rome, NY (US)

( * ) Notice: Subject to any disclaimer, the term of this patent is extended or adjusted under 35 U.S.C. 154(b) by 801 days.

(21) Appl. No.: 17/873,273

(22) Filed: Jul. 26, 2022

(51) Int. Cl.
*D06F 58/34* (2020.01)
*D06F 58/10* (2006.01)

(52) U.S. Cl.
CPC ..... *D06F 58/34* (2020.02); *D06F 58/10* (2013.01)

(58) Field of Classification Search
CPC ..... D06F 58/34; D06F 58/10
USPC ..... 34/527
See application file for complete search history.

(56) References Cited

U.S. PATENT DOCUMENTS 2,470,043 A * 5/1949 Monsarrat ..... F26B 11/181 192/136
3,432,939 A 3/1969 Eichholz
3,487,557 A 1/1970 Linstead
3,500,827 A * 3/1970 Myers ..... B64G 6/00 165/59
3,577,650 A 5/1971 Brahm
5,555,648 A * 9/1996 Griffin ..... D06F 73/00 223/67
5,930,915 A 8/1999 Dhaemers
6,038,786 A * 3/2000 Aisenberg ..... A47K 10/48 34/267
6,085,443 A * 7/2000 Hunter ..... F26B 21/06 34/174
6,780,101 B2 8/2004 Buhler
7,010,363 B2 * 3/2006 Donnelly ..... H02J 3/14 700/286
7,020,985 B2 * 4/2006 Casey ..... D06F 58/206 34/595
8,983,668 B2 * 3/2015 Ferber ..... A47L 15/481 700/286
D742,646 S 11/2015 Amago
9,861,774 B2 * 1/2018 Fu ..... A61M 16/0666
10,323,882 B2 6/2019 Durham
12,025,374 B2 * 7/2024 Raoult ..... F26B 21/10
12,214,752 B2 * 2/2025 Reed ..... B60R 9/065
12,281,847 B2 * 4/2025 Zielinski ..... F26B 3/20
2023/0118347 A1 * 4/2023 Bae ..... D06F 75/20 34/523

FOREIGN PATENT DOCUMENTS

EP 64448 A * 11/1982
FR 2701921 A1 * 9/1994 ..... B65B 69/0008
JP 2701921 B2 * 1/1998 ..... G01J 5/34
WO 9902934 1/1999

* cited by examiner

*Primary Examiner* — Stephen M Gravini
(74) *Attorney, Agent, or Firm* — Kyle A. Fletcher, Esq.

(57) ABSTRACT

The garment and equipment drying bag is a ventilation system. The garment and equipment drying bag comprises an air handling system, a control circuit, and a container. The air handling system forms a fluidic connection with the container. The control system controls the operation of the air handling system. The air handling system draws air from the atmosphere and pumps the drawn air into the container. The control circuit provides the electric energy necessary to pump the drawn air into the container. The control circuit generates heat used to warm the drawn air as it is pumped into the container. The container is configured to store sporting garments and sporting equipment.

18 Claims, 6 Drawing Sheets

GARMENT AND EQUIPMENT DRYING BAG

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of arrangements for supplying and controlling air or gases for drying solid objects. (F26B21/00)

SUMMARY OF INVENTION

The garment and equipment drying bag is a ventilation system. The garment and equipment drying bag comprises an air handling system, a control circuit, and a container. The air handling system forms a fluidic connection with the container. The control system controls the operation of the air handling system. The air handling system draws air from the atmosphere and pumps the drawn air into the container. The control circuit provides the electric energy necessary to pump the drawn air into the container. The control circuit generates heat used to warm the drawn air as it is pumped into the container. The container is configured to store sporting garments and sporting equipment.

These together with additional objects, features and advantages of the garment and equipment drying bag will be readily apparent to those of ordinary skill in the art upon reading the following detailed description of the presently preferred, but nonetheless illustrative, embodiments when taken in conjunction with the accompanying drawings.

In this respect, before explaining the current embodiments of the garment and equipment drying bag in detail, it is to be understood that the garment and equipment drying bag is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the garment and equipment drying bag.

It is therefore important that the claims be regarded as including such equivalent construction insofar as they do not depart from the spirit and scope of the garment and equipment drying bag. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
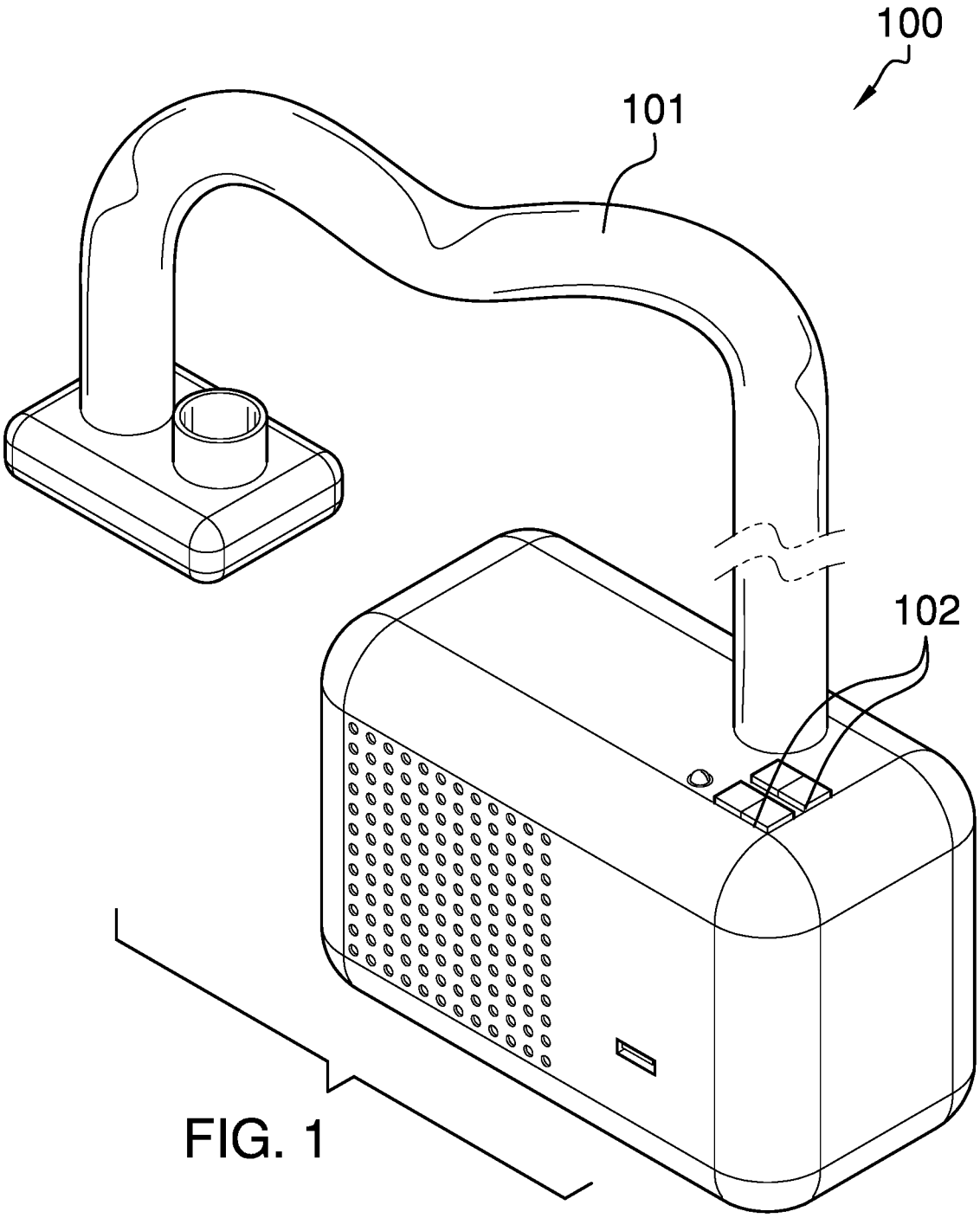
FIG. 1 is a perspective view of an embodiment of the disclosure.
Figure 2:
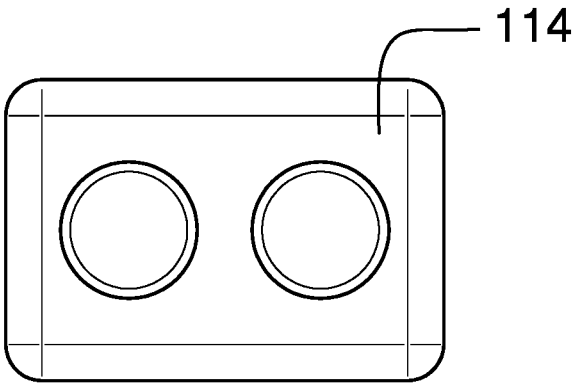
FIG. 2 is a detail view of an embodiment of the disclosure.
Figure 3:
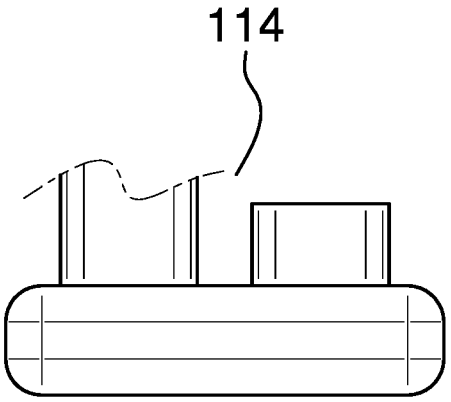
FIG. 3 is a detail view of an embodiment of the disclosure.
Figure 4:
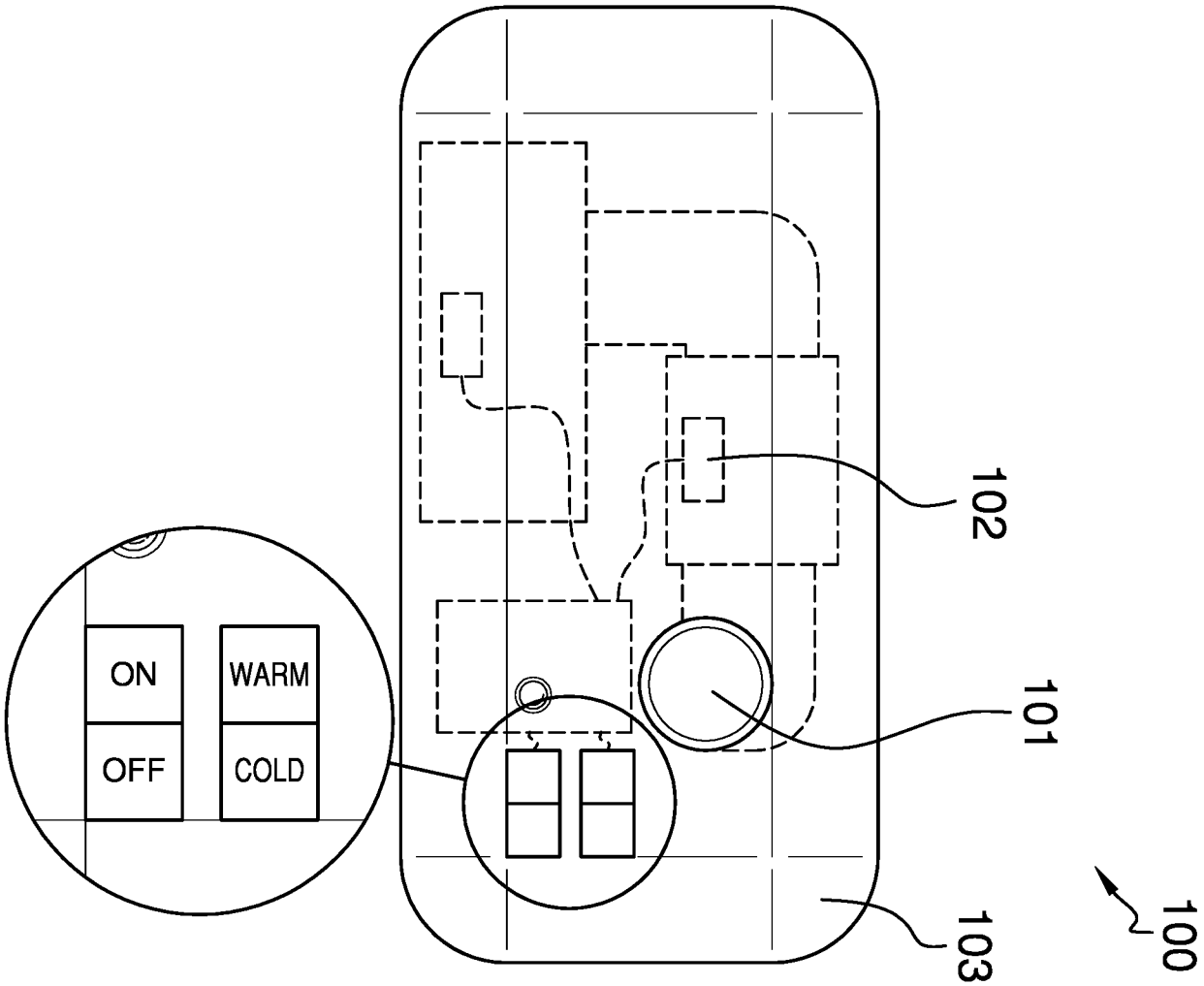
FIG. 4 is a top view of an embodiment of the disclosure.
Figure 5:
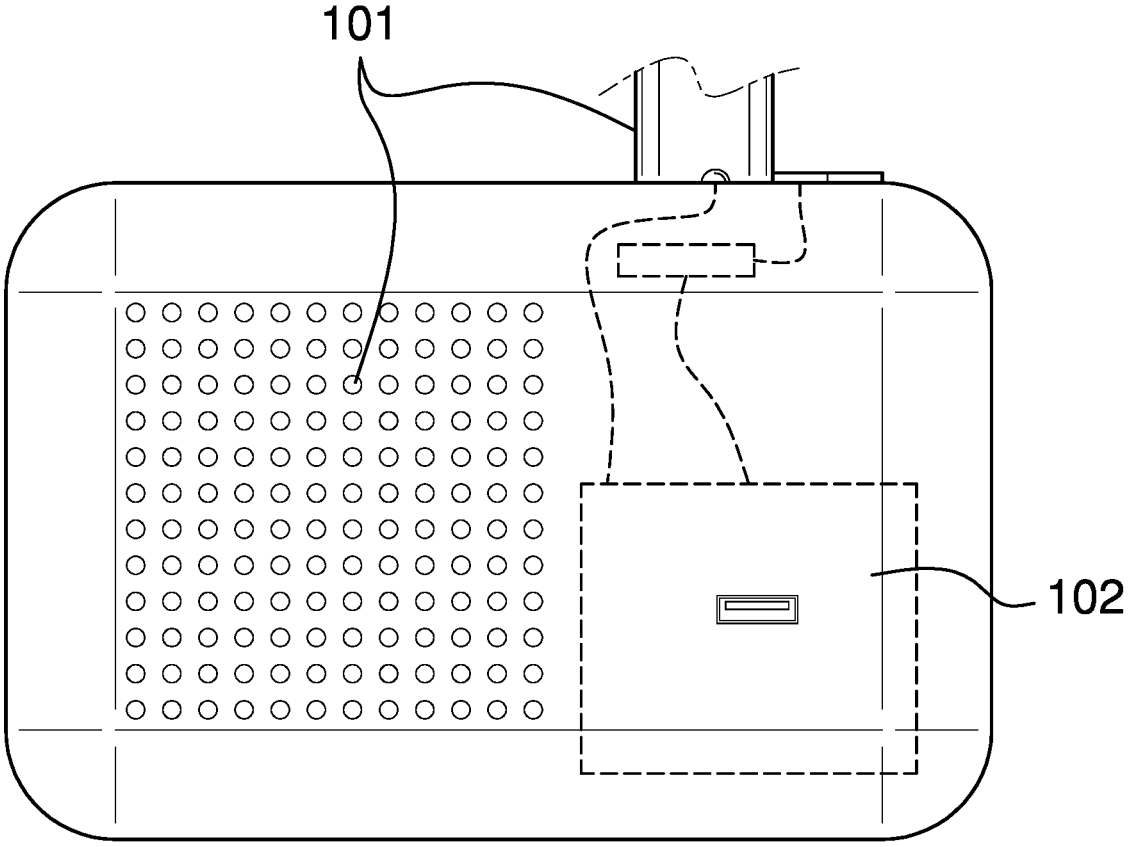
FIG. 5 is a side view of an embodiment of the disclosure.
Figure 6:
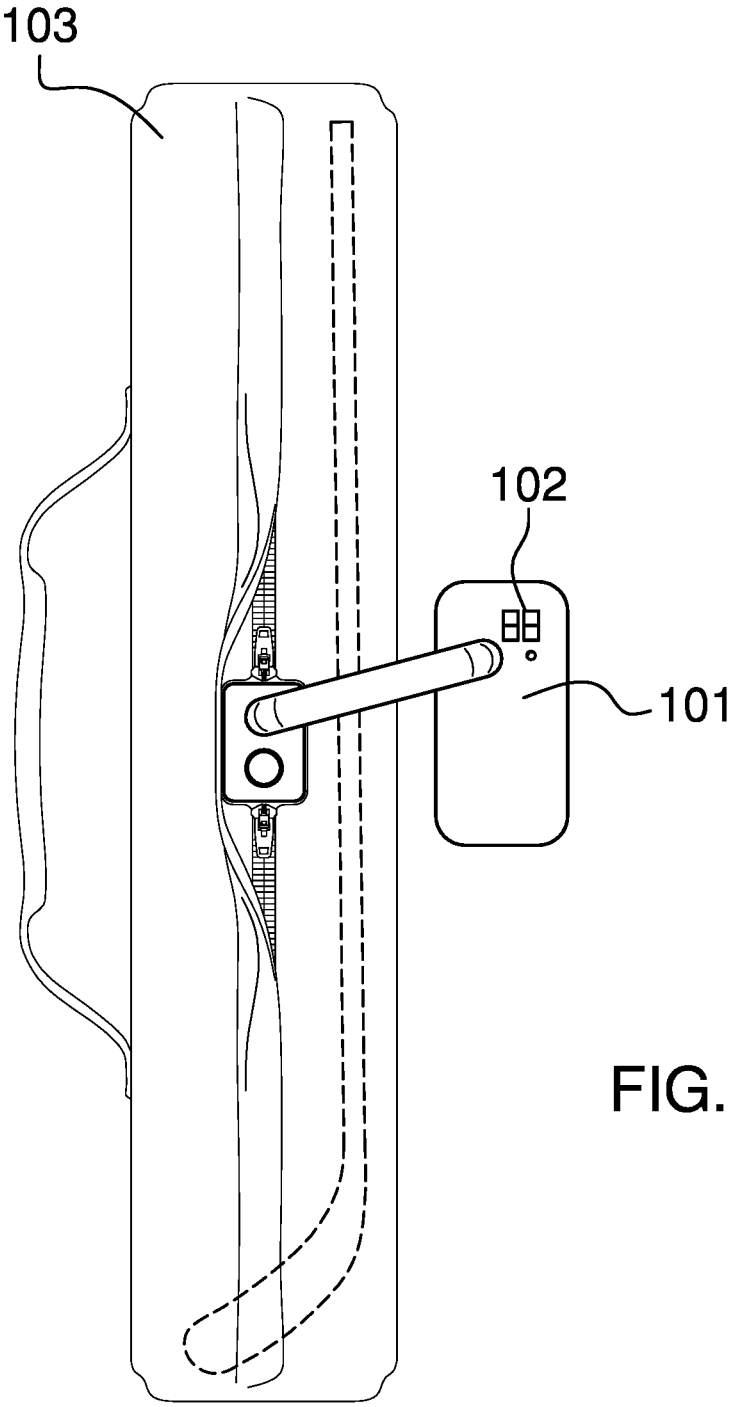
FIG. 6 is an in-use view of an embodiment of the disclosure.
Figure 7:
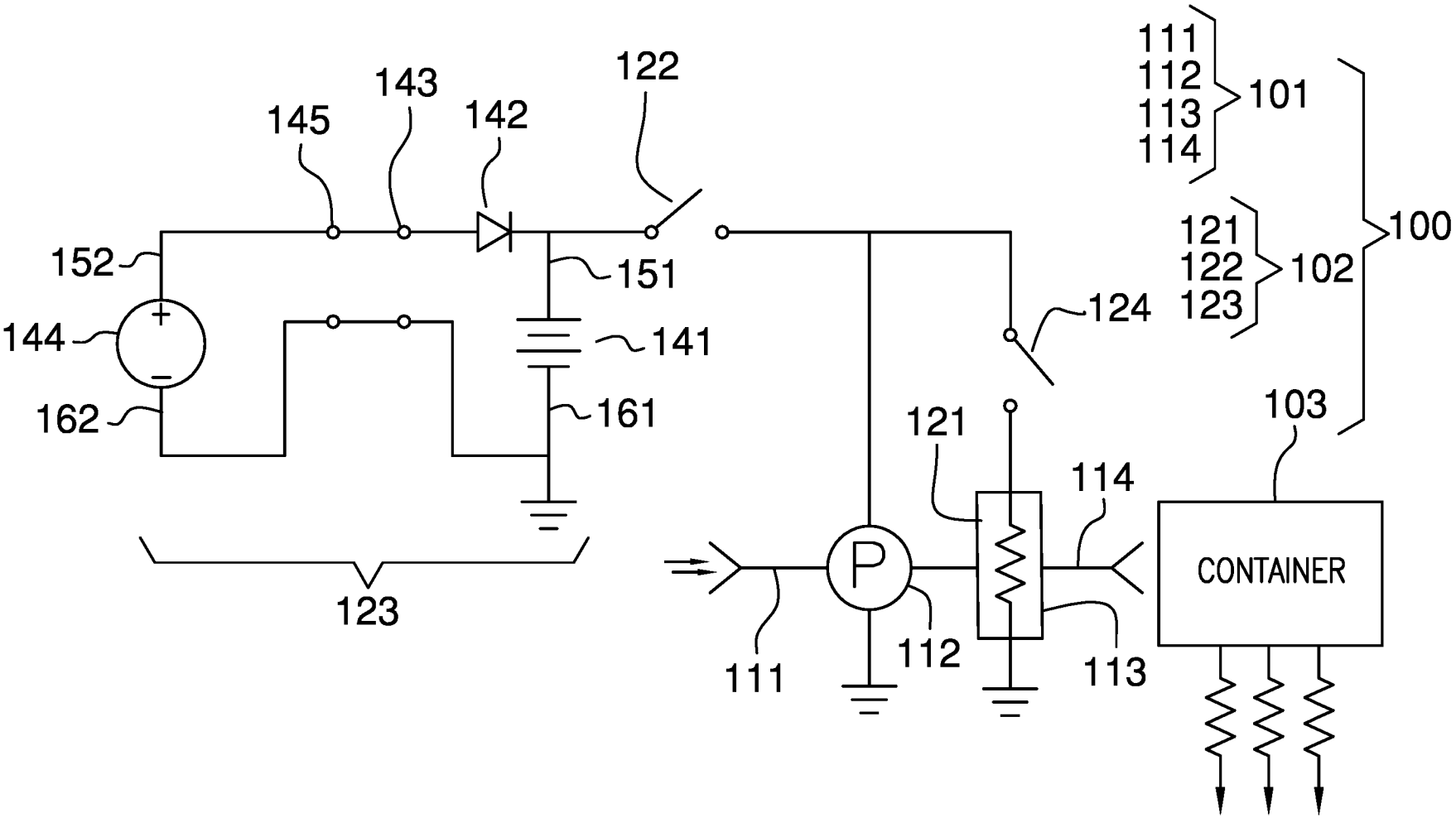
FIG. 7 is a schematic view of an embodiment of the disclosure.

Detailed reference will now be made to one or more potential embodiments of the disclosure, which are illustrated in FIGS. 1 through 7.

The garment and equipment drying bag 100 (hereinafter invention) invention 100 is a ventilation system. The invention 100 comprises an air handling system 101, a control circuit 102, and a container 103. The air handling system 102 forms a fluidic connection with the container 103. The control system controls the operation of the air handling system 102. The air handling system 102 draws air from the atmosphere and pumps the drawn air into the container 103. The control circuit 102 provides the electric energy necessary to pump the drawn air into the container 103. The control circuit 102 generates heat used to warm the drawn air as it is pumped into the container 103. The container 103 is configured to store sporting garments and sporting equipment.

The container 103 is a luggage item. The container 103 is configured for use in storing sporting garments and sporting equipment. The container 103 forms a fluidic connection with the air handling system 101. The container 103 receives warmed air from the air handling system 101. The contents of the container 103 are ventilated by the warmed air. The container 103 is formed from a fluid permeable material. The fluid permeable nature of the container 103 allows the warmed air received from the air handling system 101 to escape from the container 103 as the air pressure within the container 103 increases.

The air handling system 101 forms a ventilation system. The air handling system 101 draws air into the air handling system 101 from the atmosphere. The air handling system 101 pumps the air through the control circuit 102. The control circuit 102 warms the air flowing through the control circuit 102. The air handling system 101 receives the warmed air from the control circuit 102. The air handling system 101 transports the warmed air to the container 103. The air handling system 101 discharges the warmed air into the container 103. The air handling system 101 is an electrically powered device. The air handling system 101 receives electric energy from the control circuit 102. The control circuit 102 electrically connects to the air handling system 101. The control circuit 102 controls the operation of the air handling system 101. The air handling system 101 comprises an intake hose 111, a pump 112, a heating element 121 interface 113, and a discharge hose 114.

The intake hose 111 is a fluid transport device. The intake hose 111 is a flexible device. The intake hose 111 forms a fluidic connection between the atmosphere and the pump 112. The intake hose 111 transports air drawn into the intake hose 111 to the pump 112.

The pump 112 is a mechanical device. The pump 112 is defined elsewhere in this disclosure. The pump 112 generates a pressure differential that draws air into the pump 112 through the intake hose 111. The pressure differential provides the motive forces that transport the drawn air through the pump 112 further provides the motive forces to move the drawn air through both the heating element 121 interface 113 and the discharge hose 114 for discharge into the container 103. The pump 112 is an electrically powered device. The pump 112 forms an electric connection with the control circuit 102. The pump 112 draws the electric energy required for the operation of the pump 112 from the control circuit 102. The control circuit 102 controls the operation of the pump 112 by controlling the flow of electric energy into the pump 112.

The heating element 121 interface 113 is a hollow chamber. The heating element 121 interface 113 forms a fluid impermeable structure. The heating element 121 interface 113 forms a fluidic connection with the pump 112. The heating element 121 interface 113 forms a fluidic connection with the discharge hose 114. The heating element 121 interface 113 contains the heating element 121 of the control circuit 102. The pump 112 pumps the drawn air into the heating element 121 interface 113. The heating element 121 interface 113 passes the received drawn air over the heating element 121 such that the heating element 121 heats the drawn air to form the warmed air. The heating element 121 interface 113 discharges the warmed air into the discharge hose 114.

The discharge hose 114 forms a fluidic connection between the heating element 121 interface 113 and the container 103. The discharge hose 114 receives the warmed air from the heating element 121 interface 113. The discharge hose 114 transports the warmed air to the container 103. The discharge hose 114 discharges the warmed air into the hollow interior of the container 103.

The control circuit 102 is an electric circuit. The control circuit 102 electrically connects to the air handling system 101. The control circuit 102 forms a fluidic connection with the air handling system 101. The control circuit 102 transmits the electric energy necessary for the operation of the air handling system 101 to the air handling system 101. The control circuit 102 heats the air flowing through the air handling system 101. The control circuit 102 is an independently powered electric circuit. By independently powered is meant that the control circuit 102 can operate without an electrical connection to an external power source 144. The control circuit 102 comprises a heating element 121, a master switch 122, and a power circuit 123. The heating element 121, the master switch 122, the power circuit 123, and the pump 112 are electrically interconnected.

The heating element 121 is an electrical device. The heating element 121 converts electric energy into the heat necessary to warm the air flowing through the air handling system 101. The heating element 121 receives the electric energy necessary from the power circuit 123. The flow of electric energy into the heating element 121 is partially controlled through the master switch 122.

The heating element 121 further comprises a heating element 121 switch 124. The heating element 121 switch 124 controls the flow of electric energy into the heating element 121. The heating element 121 switch 124 is an electric switch. The heating element 121 switch 124 is a maintained switch. The heating element 121 switch 124 controls the flow of electric energy from the master switch 122 into the heating element 121.

The master switch 122 is an electric switch. The master switch 122 is a maintained switch. The master switch 122 forms an electric connection with the power circuit 123. The master switch 122 forms an electric connection with the heating element 121 switch 124 of the heating element 121. The master switch 122 forms an electric connection with the pump 112 of the air handling system 101. The master switch 122 enables and disables the flow of electric energy from the power circuit 123 to the pump 112 and the power circuit 123. The master switch 122 forms the power switch of the control circuit 102.

The operation of the pump 112 is enabled when the master switch 122 is actuated into the closed position. The operation of the master switch 122 is disabled when the master switch 122 is actuated into the open position.

The master switch 122 and the heating element 121 switch 124 combine to control the operation of the heating element 121. The heating element 121 draws electric energy from the power circuit 123 when the master switch 122 and the heating element 121 switch 124 are actuated to the closed position. The operation of the heating element 121 is disabled in any situation selected from the group consisting of: a) the master switch 122 is actuated to the open position; b) the heating element 121 switch 124 is actuated to the open position; and, c) both the master switch 122 and the heating element 121 switch 124 are simultaneously actuated to the open position.

The power circuit 123 is an electrical circuit. The power circuit 123 powers the operation of the control circuit 102. The power circuit 123 is an electrochemical device. The power circuit 123 converts chemical potential energy into the electrical energy required to power the control circuit 102. The power circuit 123 comprises a battery 141, a diode 142, a charging port 143, and an external power source 144. The external power source 144 further comprises a charging plug 145, a second positive terminal 152, and a second negative terminal 162. The battery 141 further comprises a first positive terminal 151 and a first negative terminal 161. The battery 141, the diode 142, the charging port 143, the external power source 144, and the charging plug 145 are electrically interconnected.

The battery 141 is an electrochemical device. The battery converts chemical potential energy into the electrical energy used to power the control circuit 102. The battery 141 is a commercially available rechargeable battery 141. The chemical energy stored within the rechargeable battery 141 is renewed and restored through the use of the charging port 143. The charging port 143 is an electrical circuit that reverses the polarity of the rechargeable battery 141 and provides the energy necessary to reverse the chemical processes that the rechargeable battery 141 initially used to generate the electrical energy. This reversal of the chemical process creates a chemical potential energy that will later be used by the rechargeable battery 141 to generate electricity.

The charging port 143 forms an electrical connection to an external power source 144 using a charging plug 145. The charging plug 145 forms a detachable electrical connection with the charging port 143. The charging port 143 receives electrical energy from the external power source 144 through the charging plug 145. The diode 142 is an electrical device that allows current to flow in only one direction. The diode 142 installs between the rechargeable battery 141 and the charging port 143 such that electricity will not flow from the first positive terminal 151 of the rechargeable battery 141 into the second positive terminal 152 of the external power source 144.

The following definitions were used in this disclosure:

Battery: As used in this disclosure, a battery is a chemical device consisting of one or more cells, in which chemical energy is converted into electricity and used as a source of power. Batteries are commonly defined with a positive terminal and a negative terminal.

Container: As used in this disclosure, a container is a structure that forms a protected space (or protection space) used to store and transport an object. The term containment structure is a synonym for container. Use protected space or protection space.

Control Circuit: As used in this disclosure, a control circuit is an electrical circuit that manages and regulates the behavior or operation of a device.

Diode: As used in this disclosure, a diode is a two terminal semiconductor device that allows current flow in only one direction. The two terminals are called the anode and the cathode. Electric current is allowed to pass from the anode to the cathode.

External Power Source: As used in this disclosure, an external power source is a source of the energy that is externally provided to enable the operation of the present disclosure. Examples of external power sources include, but are not limited to, electrical power sources and compressed air sources.

Fan: As used in this disclosure, a fan is a pump that moves a gas. The first potential embodiment of this disclosure assumes, but does not require, that the fan is a mechanical device with rotating blades that is used to create a flow or current of a gas.

Flow: As used in this disclosure, a flow refers to the passage of a fluid past a fixed point. This definition considers bulk solid materials as capable of flow.

Fluid: As used in this disclosure, a fluid refers to a state of matter wherein the matter is capable of flow and takes the shape of a container it is placed within. The term fluid commonly refers to a liquid or a gas.

Fluid Impermeable: As used in this disclosure, the term fluid impermeable refers to: a) the ability of a structure to not allow a fluid to pass through the structure; or, b) the ability of a material not absorb through the exterior surfaces of the material a fluid that the material is immersed in or exposed to.

Fluid Port: As used in this disclosure, a fluid port is an opening formed in an object that allows fluid to flow through the boundary of the object.

Fluidic Connection: As used in this disclosure, a fluidic connection refers to a tubular structure that transports a fluid from a first object to a second object. Methods to design and use a fluidic connections are well-known and documented in the mechanical, chemical, and plumbing arts.

Gas: As used in this disclosure, a gas refers to a state (phase) of matter that is fluid and that fills the volume of the structure that contains it. Stated differently, the volume of a gas always equals the volume of its container.

Heating Element: As used in this disclosure, a heating element is a resistive wire that is used to convert electrical energy into heat. Common metal combinations used to form heat elements include a combination of nickel and Chromium (typical: 80/20), a combination of iron, chromium and aluminum (typical 70/25/5), a combination of copper, nickel, iron, and manganese (typical 66/30/2/2) (use for continuously hot), and platinum.

Hose: As used in this disclosure, a hose is a flexible hollow prism-shaped device that is used for transporting liquids and gases. When referring to a hose in this disclosure, the terms inner dimension and outer dimension are used as they would be used by those skilled in the plumbing arts.

Liquid: As used in this disclosure, a liquid refers to a state (phase) of matter that is fluid and that maintains, for a given pressure, a fixed volume that is independent of the volume of the container.

Maintained Switch: As used in this disclosure, a maintained switch is a switch that maintains the position that was set in the most recent switch actuation. A maintained switch works in an opposite manner to a momentary switch.

Phase: As used in this disclosure, phase refers to the state of the form of matter. The common states of matter are solid, liquid, gas, and plasma.

Plug: As used in this disclosure, a plug is an electrical termination that electrically connects a first electrical circuit to a second electrical circuit or a source of electricity. As used in this disclosure, a plug will have two or three metal pins.

Port: As used in this disclosure, a port is an electrical termination that is used to connect a first electrical circuit to a second external electrical circuit. In this disclosure, the port is designed to receive a plug.

Pump: As used in this disclosure, a pump is a mechanical device that uses suction or pressure to raise or move fluids, compress fluids, or force a fluid into an inflatable object. Within this disclosure, a compressor refers to a pump that is dedicated to compressing a fluid or placing a fluid under pressure.

Solid: As used in this disclosure, a solid refers to a state (phase) of matter that: 1) has a fixed volume; and, 2) does not flow.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The invention claimed is:

1. A garment and equipment drying bag comprising
an air handling system, a control circuit, and a container;
wherein the air handling system forms a fluidic connection with the container;
wherein the control circuit controls an operation of the air handling system;
wherein the container is configured to store sporting garments and sporting equipment;
wherein the air handling system comprises an intake hose, a pump, a heating element interface, and a discharge hose;
wherein the discharge hose forms a fluidic connection between the heating element interface and the container;
wherein the discharge hose receives a warmed air from the heating element interface;
wherein the discharge hose transports the warmed air to the container;
wherein the discharge hose is configured to discharge the warmed air into a hollow interior of the container so as to dry sporting garments and sporting equipment stored within the container.

2. The garment and equipment drying bag according to claim 1
wherein the air handling system draws air from an atmosphere and pumps a drawn air into the container;
wherein the control circuit provides an electric energy necessary to pump the drawn air into the container;
wherein the control circuit generates heat used to warm the drawn air as it is pumped into the container.

3. The garment and equipment drying bag according to claim 2
wherein the container forms a fluidic connection with the air handling system;
wherein the container receives the warmed air from the air handling system;
wherein contents of the container are ventilated by the warmed air.

4. The garment and equipment drying bag according to claim 3
wherein the container is formed from a fluid permeable material;
wherein the fluid permeable nature of the container allows the warmed air received from the air handling system to escape from the container as an air pressure within the container increases.

5. The garment and equipment drying bag according to claim 4
wherein the air handling system forms a ventilation system;
wherein the air handling system draws air into the air handling system from the atmosphere;
wherein the air handling system pumps the air through the control circuit;
wherein the control circuit warms the air flowing through the control circuit;
wherein the air handling system receives the warmed air from the control circuit;
wherein the air handling system transports the warmed air to the container;
wherein the air handling system discharges the warmed air into the container.

6. The garment and equipment drying bag according to claim 5
wherein the air handling system is an electrically powered device;
wherein the air handling system receives electric energy from the control circuit;
wherein the control circuit electrically connects to the air handling system;
wherein the control circuit controls the operation of the air handling system.

7. The garment and equipment drying bag according to claim 6
wherein the control circuit is an electric circuit;
wherein the control circuit electrically connects to the air handling system;
wherein the control circuit forms a fluidic connection with the air handling system;
wherein the control circuit transmits the electric energy necessary for the operation of the air handling system to the air handling system
wherein the control circuit heats the air flowing through the air handling system.

8. The garment and equipment drying bag according to claim 7
wherein the control circuit is an independently powered electric circuit;
wherein by independently powered is meant that the control circuit can operate without an electrical connection to an external power source.

9. The garment and equipment drying bag according to claim 8
wherein the intake hose, the pump, the heating element interface, and the discharge hose are fluidically interconnected.

10. The garment and equipment drying bag according to claim 9
wherein the control circuit comprises a heating element, a master switch, and a power circuit;
wherein the heating element, the master switch, the power circuit, and the pump are electrically interconnected.

11. The garment and equipment drying bag according to claim 10
wherein the intake hose is a fluid transport device;
wherein the intake hose is a flexible device;
wherein the intake hose forms a fluidic connection between the atmosphere and the pump;
wherein the intake hose transports air drawn into the intake hose to the pump.

12. The garment and equipment drying bag according to claim 11
wherein the pump is a mechanical device;
wherein the pump generates a pressure differential that draws in the drawn air into the pump through the intake hose.

13. The garment and equipment drying bag according to claim 12
wherein the pump is an electrically powered device;

wherein the pump forms an electric connection with the control circuit;

wherein the pump draws the electric energy required for an operation of the pump from the control circuit;

wherein the control circuit controls the operation of the pump by controlling a flow of electric energy into the pump.

14. The garment and equipment drying bag according to claim 13 wherein the heating element interface is a hollow chamber;

wherein the heating element interface forms a fluid impermeable structure;

wherein the heating element interface forms a fluidic connection with the pump;

wherein the heating element interface forms a fluidic connection with the discharge hose;

wherein the heating element interface contains the heating element of the control circuit;

wherein the pump pumps the drawn air into the heating element interface;

wherein the heating element interface passes the drawn air over the heating element such that the heating element heats the drawn air to form the warmed air;

wherein the heating element interface discharges the warmed air into the discharge hose.

15. The garment and equipment drying bag according to claim 14 wherein the heating element is an electrical device;

wherein the heating element converts electric energy into the heat necessary to warm the air flowing through the air handling system;

wherein the heating element receives the electric energy necessary from the power circuit;

wherein a flow of electric energy into the heating element is partially controlled through the master switch;

wherein the heating element further comprises a heating element switch;

wherein the heating element switch controls the flow of electric energy into the heating element;

wherein the heating element switch is an electric switch;

wherein the heating element switch is a maintained switch.

16. The garment and equipment drying bag according to claim 15 wherein the master switch is an electric switch;

wherein the master switch is a maintained switch;

wherein the master switch forms an electric connection with the power circuit;

wherein the master switch forms an electric connection with the heating element switch of the heating element;

wherein the master switch forms an electric connection with the pump of the air handling system;

wherein the master switch enables and disables the flow of electric energy from the power circuit to the pump and the power circuit;

wherein the master switch forms the power switch of the control circuit;

wherein the operation of the pump is enabled when the master switch is actuated into the closed position;

wherein an operation of the master switch is disabled when the master switch is actuated into an open position;

wherein the master switch and the heating element switch combine to control an operation of the heating element;

wherein the heating element draws electric energy from the power circuit when the master switch and the heating element switch are actuated to a closed position;

wherein the operation of the heating element is disabled in any situation selected from a group consisting of: a) the master switch is actuated to the open position; b) the heating element switch is actuated to the open position; and, c) both the master switch and the heating element switch are simultaneously actuated to the open position.

17. The garment and equipment drying bag according to claim 16 wherein the power circuit is an electrical circuit;

wherein the power circuit powers an operation of the control circuit;

wherein the power circuit is an electrochemical device;

wherein the power circuit converts chemical potential energy into the electrical energy required to power the control circuit.

18. The garment and equipment drying bag according to claim 17 wherein the power circuit comprises a battery, a diode, a charging port, and an external power source;

wherein the external power source further comprises a charging plug;

wherein the battery, the diode, the charging port, the external power source, and the charging plug are electrically interconnected.

* * * * *